US008613429B2

(12) United States Patent
Araki

(10) Patent No.: US 8,613,429 B2
(45) Date of Patent: Dec. 24, 2013

(54) CARBURETOR

(75) Inventor: Satoru Araki, Ebina Kanagawa (JP)

(73) Assignee: Zama Japan Kabushiki Kaisha, Iwate (JP)

( * ) Notice: Subject to any disclaimer, the term of this patent is extended or adjusted under 35 U.S.C. 154(b) by 389 days.

(21) Appl. No.: 12/952,433

(22) Filed: Nov. 23, 2010

(65) Prior Publication Data

US 2011/0121471 A1 May 26, 2011

(30) Foreign Application Priority Data

Nov. 25, 2009 (JP) ..... 2009-267391

(51) Int. Cl.
*F02M 1/10* (2006.01)
*F02M 17/40* (2006.01)

(52) U.S. Cl.
USPC ..... 261/39.3; 261/39.4; 261/55; 261/63

(58) Field of Classification Search
USPC ..... 261/39.1, 39.3, 39.5, 45, 46, 54, 55, 63
See application file for complete search history.

(56) References Cited

U.S. PATENT DOCUMENTS 3,186,692 A * 6/1965 Moseley ..... 261/39.3
3,730,155 A * 5/1973 Knapp ..... 123/452
3,831,909 A * 8/1974 Freismuth ..... 261/39.2
6,003,845 A * 12/1999 Kus ..... 261/39.4
6,186,482 B1 * 2/2001 Nomura ..... 261/43
7,104,526 B2 * 9/2006 Mavinahally ..... 261/46
7,246,794 B2 * 7/2007 Suzuki et al. ..... 261/52
2006/0022359 A1 * 2/2006 Edamatsu et al. ..... 261/39.1

FOREIGN PATENT DOCUMENTS

JP 52-043034 A * 4/1977 ..... 261/46
JP 60-030459 A * 2/1985 ..... 261/39.4
JP 62-052260 6/1987
JP 4-65959 6/1992

* cited by examiner

*Primary Examiner* — Richard L Chiesa
(74) *Attorney, Agent, or Firm* — Kenneth S. Roberts; One LLP

(57) ABSTRACT

A carburetor having a choke valve has an open-close valve sliding reciprocatingly inside a valve hole partway along a bypass air passage. The open-close valve, pressed by urging member, slides according to a rotation angle of a choke valve shaft while a distal end side continuously contacts a side face of the shaft. A projecting part, urged by a coil spring, projects from a distal end of a body. The urging member includes a temperature-sensitive material that expands at or above a prescribed temperature. When the choke valve is closed and the ambient temperature is less than the prescribed temperature, the bypass air passage enters a closed state while the body remains in a closed-valve position; and when the ambient temperature is at or above the prescribed temperature, the urging member elongates and the body enters an open-valve position, and the bypass air passage enters an open state.

6 Claims, 2 Drawing Sheets

CARBURETOR

RELATED APPLICATION INFORMATION

This application claims priority under 35 U.S.C. §119 to Japanese Appl. No. 2009-2673391.

BACKGROUND OF THE INVENTION

1. Field of the Invention

The present invention relates to a carburetor for supplying fuel to an engine, and in particular relates to a carburetor having a bypass air passage for bypassing a choke valve to supply intake air during choke application.

2. Description of the Related Art

When an engine is started up before being warmed up, it is common to close a choke valve provided in a carburetor to control the air intake and enrich a gas mixture of fuel and air. It is also known to provide a small hole in the choke valve in order to cause the engine to continue running satisfactorily right after being started; e.g., as described in Japanese Laid-open Utility Model Publication No. 62-52260.

However, while the use of a richer gas mixture is preferred when the engine is started up in cold weather, in comparatively warm weather it is not desirable to use a gas mixture having the same concentration as in cold weather to have the engine keep running right after being started; therefore, the air intake should be adjusted to provide a gas mixture whose concentration corresponds to the atmospheric temperature.

Accordingly, there has been proposed a carburetor having a manual coke valve, as described in Japanese Laid-open Utility Model Publication No. 4-65959, wherein there is provided a bypass air passage for bypassing the choke valve and supplying intake air by having an air intake passage on an upstream side and an air intake passage on a downstream side connected when the choke valve is in a fully closed position. A temperature-sensitive valve for controlling an amount of bypass air in accordance with an engine coolant temperature is provided partway along the bypass air passage.

Thus, there is provided air flow volume adjusting means incorporating a temperature-sensitive valve provided partway along a passage for bypassing the choke valve, whereby opening the valve as wide as the engine coolant temperature is high can increase the flow of bypass air during engine start-up, and the gas mixture will be more readily adjusted automatically to a concentration corresponding to the temperature during engine start-up.

However, with a scheme in which a temperature-sensitive valve is opened or closed in accordance with variations in the engine coolant temperature, a time lag tends to occur when the engine coolant temperature changes in response to the change in the ambient temperature before and after engine start-up. Therefore, a gas mixture having an adequate concentration according to the atmospheric temperature may not be provided. With a temperature-sensitive body comprising a common temperature-sensitive valve, the valve body only moves a small amount in response to temperature variation. Therefore, the temperature-sensitive valve is not readily set to a large degree of opening or closing in the bypass air passage, increasing the number of instances in which a sufficient flow volume of bypass air in cold weather cannot be adequately ensured.

SUMMARY OF THE INVENTION

The present invention was conceived in order to solve problems as described above. An object thereof being to provide a carburetor having a manual choke valve, wherein it is possible to provide a gas mixture of adequate concentration in accordance with the atmospheric temperature during start-up before the engine has warmed up and during continued running of the engine immediately after it has been started up.

A carburetor comprising: a manual choke valve; a bypass air passage for connecting an upstream side and a downstream side of the choke valve and supplying air during engine start-up before warm-up when the choke valve is closed; and an air flow volume adjusting means for adjusting the air flow volume of the bypass air passage in accordance with a temperature condition. The air flow volume adjusting means has a cylindrical valve hole provided partway along the bypass air passage, and a piston-shaped open-close valve that slides reciprocatingly inside the valve hole to open and close the bypass air passage. A proximal end side of the open-close valve is pressed by an urging means. A distal end side is in continuous contact with a side face of a choke valve shaft while being pressed and caused to slide by the side face of the choke valve shaft so that the distance from a central axis varies in accordance with an angle of rotation of the choke valve shaft. A projecting part that projects from and recedes into the distal end of a body of the open-close valve is urged by an elastic body to allow the length in the direction of sliding to vary in an elastic fashion so that the distal end face is continuously pressed against the side face of the choke valve shaft. The urging means comprises a temperature-sensitive material and elongates in the direction of sliding at or above the aforementioned prescribed temperature. When the choke valve is fully open, the bypass air passage is closed by the open-close valve. When the choke valve is closed and in the case when the ambient temperature is lower than the aforementioned prescribed temperature, the projecting part projects while the body of the open-close valve is kept in a closed valve position without the urging means elongating, and the bypass air passage is put into a closed state. When the choke valve is closed when the ambient temperature is at or above the aforementioned prescribed temperature or higher, the urging means elongates and the body is put into an open valve position while the projecting part is caused to recede, and the bypass air passage is put into an open state.

Thus, in a carburetor having a function for adjusting the air flow in a bypass air passage in accordance with a temperature condition, the bypass air passage is opened or closed by an open-close valve that undergoes a sliding action in accordance with an angle of rotation of a choke valve shaft and that can deform elastically in length, and a proximal end side of the open-close valve is pressed by urging means that elongates at a preset temperature or higher so that the bypass air passage is opened, whereby the bypass air passage can be closed during start-up in cold weather when a rich gas mixture is required, the bypass air passage can be opened during start-up in warm weather when a leaner gas mixture is required, and a gas mixture having an adequate density according to the temperature state can be supplied.

If the urging means is formed in a configuration of a coiled spring using a shape memory alloy, then a reliable open valve state is readily ensured according to the temperature state, the open-close valve will readily have a large stroke, and an adequate flow of bypass air is readily provided according to need.

In this case, the action of opening and closing the bypass air passage will tend to be readily accomplished if the projecting part of the open-close valve comprises a cylindrical member and is inserted, with an interposed coil spring, into a cylindrical insertion hole that is open on the distal end face of the aforementioned body and is of a larger diameter than the projecting part and if the coil spring is set to have a stiffness that is less than a spring stiffness of the urging means during elongation.

An adequate flow of bypass air will be readily provided from the start of the opening action of the open-close valve if the bypass air passage in the carburetor has an auxiliary passage parallel to a main passage, and if the auxiliary passage is substantially fully open and bypass air is supplied therethrough during a first half of the stroke in an opening direction of the open-close valve.

According to the present invention in which an open-close valve that can elastically deform in a length direction is driven by urging means comprising a temperature-sensitive material to perform a sliding action, and open or close, in accordance with an angle of rotation of a choke valve shaft; and in which a bypass air passage is closed during start-up in cold weather and opened during start-up in warm weather, a gas mixture having an adequate concentration according to the atmospheric temperature can be supplied when an engine is started before warming up and while the engine runs continuously right after start-up.

KEY

Figure 1:
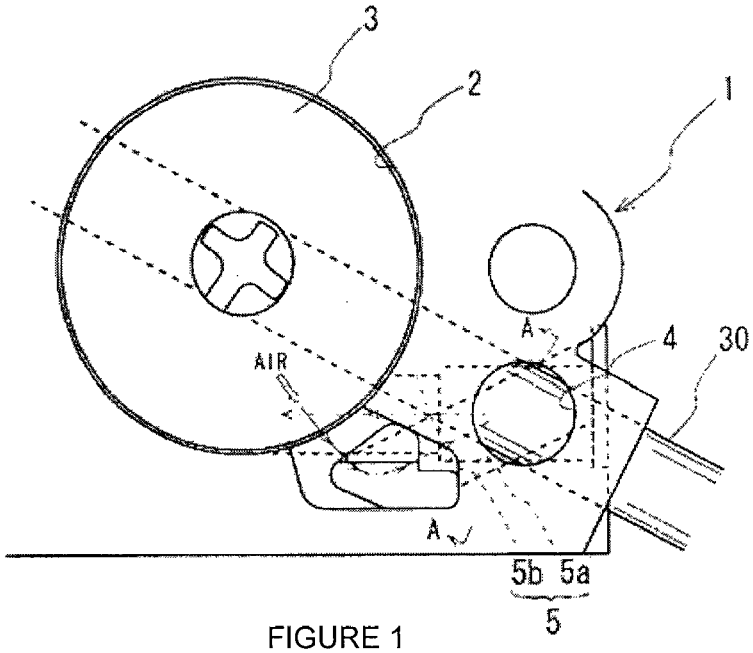
FIG. 1 is a partial front view of a carburetor that is one embodiment of the present invention, centered on the bypass air passage section and viewed from the air inflow side.

1 Carburetor
2 Air intake passage
3 Choke valve
4 Valve hole
5 Bypass air passage
5*a* Upstream side
5*b* Downstream side
5*c* Auxiliary passage
30 Choke valve shaft
40 Open-close valve
40*b* SMA spring
41 Body
41*a* Insertion hole
42 Projecting part
42*a* Spring hole
42*b* Coil spring

DESCRIPTION OF THE PREFERRED EMBODIMENTS

An embodiment of the present invention is described below with reference to the accompanying drawings.

FIG. 1 shows the structure of a carburetor 1 as the embodiment, viewed from the air inflow side when a bypass air passage 5 is open, wherein the arrow indicates the route the air flow takes. The carburetor 1 is provided with a choke mechanism for opening and closing a choke valve 3 provided in an air intake passage 2 in response to manual rotational operation of a choke valve shaft 30, and is provided with a bypass air passage 5 for bypassing an upstream side and a downstream side of the choke valve 3 to supply air.

Figure 2:
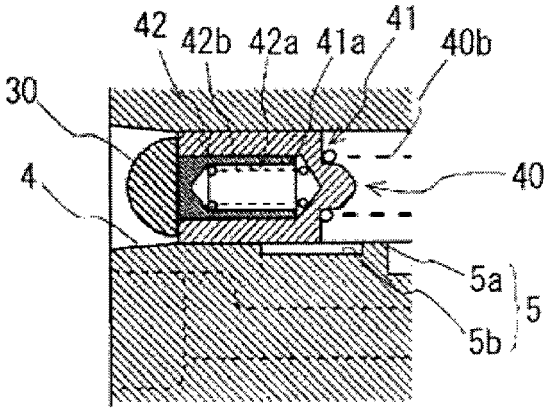
FIG. 2 is a partial sectional view along line A-A in FIG. 1.

As shown in FIG. 2, which is a partial sectional view along line A-A in FIG. 1, the bypass air passage 5 has a cylindrical valve hole 4 formed partway therealong, and is divided into an upstream side 5*a* and a downstream side 5*b*. A piston-shaped open-close valve 40 is disposed inside the valve hole 4 to be capable of a reciprocating sliding operation, thus constituting air flow volume adjusting means for opening and closing the bypass air passage 5 and adjusting the flow of bypass air.

The open-close valve 40 is configured to perform a reciprocating sliding action inside the valve hole 4 as a consequence of being pressed on a proximal end side by a coiled SMA spring 40*b* constituting urging means, and being pressed on a distal end face over a distance between a choke valve shaft 30, which has a cut-out part describing a half-moon in cross-section, and the center axis that varies according to the rotational action of the choke valve shaft 30, while the distal end face is in continuous contact with a contact part on the outer perimeter face.

As shown in partial longitudinal sectional view in FIG. 2, the open-close valve 40 comprises: a body 41, which has the shape of a cylinder having an outer diameter that is substantially equal to the inner diameter of the valve hole 4, and has an insertion hole 41*a* open on a distal end face. A projecting part 42, which has the shape of a cylinder having an outer diameter that is substantially equal to the inner diameter of the insertion hole 41*a*, has a spring hole 42*a* open on a proximal end face, and is inserted while a coil spring 42*b* that is an elastic body and is longer than the spring hole 42*a* is deep is compressed and disposed between a bottom face of the spring hole 42*a* and a bottom face of the insertion hole 41*a*. The coil spring 42*b* is capable of elastically expanding and contracting within a prescribed range in the length direction, and in the most contracted state a distal end face of the projecting part 42 is coplanar with the distal end face of the body 41.

The SMA spring 40*b* constituting urging means on the proximal end side of the open-close valve 40 is formed into a coiled spring configuration using a shape-memory alloy (SMA) that is a temperature-sensitive material, and elongates in the direction of sliding in the case when the ambient temperature is at or above a set temperature, so that the urging force on the open-close valve 40 is increased.

Specifically, when the choke valve 3 is fully open, the open-close valve 40 is in a state in which the bypass air passage 5 is closed, but in the case when the choke valve 3 is closed during cold start-up and the ambient temperature is less than the set temperature, the SMA spring 40*b* is at a length by which the body 41 of the open-close valve 40 is kept in the closed valve position, and the projecting part 42 extends by the urging force of the coil spring 42*b* so that the distal end is brought in contact with the cut-out part of the choke valve shaft 30, in which state the closed state of the bypass air passage 5 is maintained.

In the case that the choke valve 3 is closed during cold start-up and the ambient temperature is at the set temperature or higher, the SMA spring 40*b* elongates and the urging force thereof overcomes the urging force of the coil spring 42*b*, so that the open-close valve 40 is compressed and the bypass air passage 5 is caused to assume an open state. This point is one characteristic of the present invention.

Figure 3:
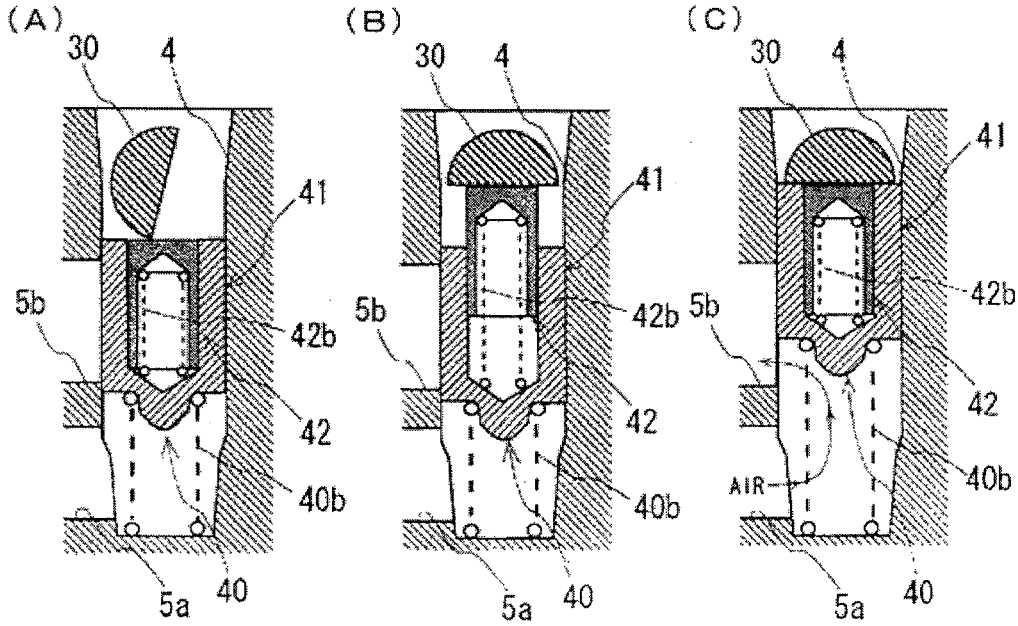
FIG. 3 shows (A) a partial longitudinal sectional view showing a state of the bypass air passage when the choke valve is fully open in the carburetor shown in FIG. 1; (B) a partial longitudinal sectional view showing a state of the bypass air passage when the choke valve is fully closed in cold weather; and (C) a partial longitudinal sectional view showing a state of the bypass air passage when the choke valve is fully closed in warm weather.

The operation of the carburetor 1 that is the embodiment shall now be described with reference to FIG. 3. FIG. 3(A) shows a case when the choke valve 3 is fully open. The bypass air passage 5 is fully closed, the opening end on the downstream side 5*b* of the bypass air passage 5 blocked by the side face of the open-close valve 40, in a state in which the large-diameter part of the choke valve shaft 30 having a cut-out part is in contact with the distal end face of the open-close valve 40.

FIG. 3(B) shows a case where the choke valve 3 is in a fully closed state during engine start-up in cold weather. The SMA spring 40*b* is made of a shape memory alloy, as previously described, and exhibits almost no urging force at the prevailing ambient temperature while kept in a condition of being short and unelongated. The projecting part 42 projects by the urging force of the coil spring 42*b* while in a state in which the bypass air passage 5 is closed by the body 41, and the distal end face is placed in contact with the small-diameter part of the choke valve shaft 30 having a cut-out part. The gas mixture thereby becomes richer without air being supplied from the bypass air passage 5, and smooth engine start-up is accomplished.

On the other hand, FIG. 3(C) shows the case when the choke valve 3 is in the fully closed state during engine start-up in warm weather. The SMA spring 40*b* is configured to expand by the action of the shape memory alloy in the case when the ambient temperature is at or above a level at which the gas mixture is preferably not made as rich as in the case in FIG. 3(B) during engine start-up and during continued running immediately after start-up. The spring stiffness during expansion therefore overcomes the spring stiffness of the coil spring 42*b* so that the body 41 of the open-close valve 40 is pushed up, and the opening end of the downstream side 5*b* is exposed so that the bypass air passage 5 is opened.

Air is thereby supplied through the bypass air passage 5 so that the gas mixture becomes leaner than in the case in FIG. 3(B), and continued running of the engine immediately after start-up is satisfactorily performed. Since choking is canceled and the choke valve 3 becomes fully open if engine start-up is completed, the open-close valve 40 and the SMA spring 40*b* are reset to the state in FIG. 3(A), and readied for the next choke.

Forming the SMA spring 40*b* that constitutes urging means at the proximal end side of the open-close valve 40 in a coiled spring configuration results in the open-close valve 40 performing a large amount of sliding; therefore, a sufficient flow of bypass air is readily provided. Since the SMA spring 40*b* reacts intimately to variation of ambient temperature, the time lag of operation is minor compared to a configuration in which operation depends on variation of engine coolant temperature to open or close the bypass air passage, as in the conventional example. Since the switching temperature for the opening and closing operations performed by the open-close valve 40 can be suitably determined by the composition ratio of the shape memory alloy, and since the set temperature changes over a gentle curve between prior and subsequent circumstances, the operation approximates the actual requirement and produces a desirable result.

Figure 4:
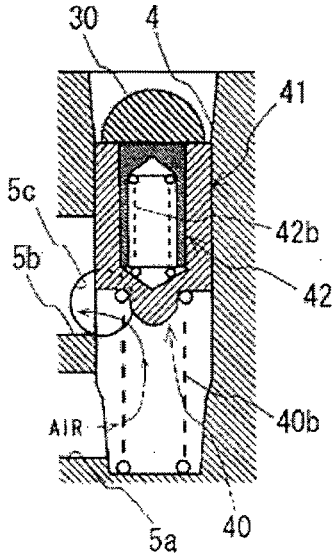
FIG. 4 is a partial longitudinal sectional view showing a state of the bypass air passage when the choke valve is fully closed in warm weather in an example of application of the carburetor in FIG. 1.

FIG. 4 shows an example of application of the embodiment described above, and shows a case in which the bypass air passage is provided with an auxiliary passage 5*c* that is connected in parallel to the downstream side 5*b*, which is the main passage, and has a smaller diameter. Since the auxiliary passage 5*c* thereby becomes substantially fully open even with a small stroke in the opening direction of the open-close valve 40, a sufficient flow volume of bypass air is readily provided at the start of the valve opening operation of the open-close valve 40.

According to the present invention, in a carburetor having a manual choke valve, a gas mixture having an adequate concentration in accordance with the atmospheric temperature can be provided while an engine is being started before being warmed up and during continued running immediately after start-up, as has been described above.

While the invention is susceptible to various modifications, and alternative forms, specific examples thereof have been shown in the drawings and are herein described in detail. It should be understood, however, that the invention is not to be limited to the particular forms or methods disclosed, but to the contrary, the invention is to cover all modifications, equivalents and alternatives falling within the spirit and scope of the appended claims.

What is claimed is:

1. A carburetor comprising:

a manual choke valve;

a bypass air passage for connecting an upstream side and a downstream side of the choke valve and supplying air during engine start-up before warm-up when the choke valve is closed; and air flow volume adjusting means for adjusting the air flow of the bypass air passage in accordance with a temperature condition, wherein:

the air flow volume adjusting means has a cylindrical valve hole provided partway along said bypass air passage, and a piston-shaped open-close valve that slides reciprocatingly inside the valve hole to open and close said bypass air passage;

a proximal end side of the open-close valve is pressed by an urging means, and a distal end side is in continuous contact with a side face of a choke valve shaft while being urged and caused to slide by said side face so that the distance from a central axis of said choke valve shaft varies in accordance with an angle of rotation of said choke valve shaft;

a projecting part that projects from and recedes into the distal end of a body of said open-close valve is urged by an elastic body to allow the length in the direction of sliding to vary in an elastic fashion so that the distal end face is continuously pressed against said side face;

said urging means comprises a temperature-sensitive material, and elongates in the direction of sliding at or above a prescribed set temperature; and when said choke valve is fully open, said bypass air passage is closed by said open-close valve; when said choke valve is closed and in the case when the ambient temperature is lower than said prescribed temperature, said projecting part projects while said body is kept in a closed valve position without said urging means elongating, and said bypass air passage is put into a closed state; and when said choke valve is closed when the ambient temperature is at or above said prescribed temperature, said urging means elongates and said body is put into an open valve position while said projecting part is caused to recede, and said bypass air passage is put into an open state.

2. The carburetor according to claim 1, wherein said urging means is formed into a coil spring configuration using a shape memory alloy.

3. The carburetor according to claim 2, wherein said projecting part of said open-close valve has a cylindrical member and is inserted, with an interposed coil spring, into a cylindrical insertion hole that is open on the distal end face of said body and is of a larger diameter than said projecting part, and said coil spring is set to have a stiffness that is less than a spring stiffness of said urging means.

4. The carburetor according to claim 1, wherein said bypass air passage includes an auxiliary passage in parallel with a main passage, and the auxiliary passage is substantially fully open to supply bypass air during a first half of a stroke in an opening direction of said open-close valve.

5. The carburetor according to claim 2, wherein said bypass air passage includes an auxiliary passage in parallel with a main passage, and the auxiliary passage is substantially fully open to supply bypass air during a first half of a stroke in an opening direction of said open-close valve.

6. The carburetor according to claim 3, wherein said bypass air passage includes an auxiliary passage in parallel with a main passage, and the auxiliary passage is substantially fully open to supply bypass air during a first half of a stroke in an opening direction of said open-close valve.

* * * * *